US010636592B2

(12) United States Patent
Wang

(10) Patent No.: US 10,636,592 B2
(45) Date of Patent: Apr. 28, 2020

(54) KEYBOARD DEVICE

(71) Applicant: Primax Electronics Ltd., Taipei (TW)

(72) Inventor: Yi-Chen Wang, Taipei (TW)

(73) Assignee: PRIMAX ELECTRONICS LTD, Taipei (TW)

( * ) Notice: Subject to any disclaimer, the term of this patent is extended or adjusted under 35 U.S.C. 154(b) by 0 days.

(21) Appl. No.: 16/110,721

(22) Filed: Aug. 23, 2018

(65) Prior Publication Data

US 2019/0378666 A1 Dec. 12, 2019

(30) Foreign Application Priority Data

Jun. 8, 2018 (TW) ..... 107119889 A

(51) Int. Cl.

| | |
|---|---|
| ***H01H 13/14*** | (2006.01) |
| ***H01H 13/20*** | (2006.01) |
| ***H01H 13/702*** | (2006.01) |
| ***H01H 13/10*** | (2006.01) |
| ***H01H 13/04*** | (2006.01) |

(52) U.S. Cl.

CPC ..... *H01H 13/14* (2013.01); *H01H 13/04* (2013.01); *H01H 13/10* (2013.01); *H01H 13/20* (2013.01); *H01H 13/702* (2013.01); *H01H 2233/07* (2013.01)

(58) Field of Classification Search

CPC ..... H01H 13/14; H01H 13/10; H01H 13/04; H01H 13/702; H01H 13/20; H01H 2233/07; H01H 13/7065; H01H 3/125

USPC ..... 200/344, 345

See application file for complete search history.

(56) References Cited

U.S. PATENT DOCUMENTS

2018/0025859 A1* 1/2018 Chen ..... H01H 13/14 200/5 A

2018/0075985 A1* 3/2018 Huang ..... H01H 13/14

* cited by examiner

*Primary Examiner* — Edwin A. Leon

*Assistant Examiner* — Lheiren Mae A Caroc

(74) *Attorney, Agent, or Firm* — Kirton McConkie; Evan R. Witt

(57) ABSTRACT

A keyboard device includes a membrane circuit board, a base plate and a key. The key includes a keycap, a connecting element and a stabilizer bar. The connecting element is connected between the keycap and the base plate. The stabilizer bar is connected between the keycap and the connecting element. While the keycap is moved upwardly or downwardly relative to the base plate, the stabilizer bar is swung to stabilize the key. Since the stabilizer bar is connected between the keycap and the connecting element, the stabilizer bar does not readily collide with or knock on the base plate. During the process of operating the key, the generated noise is reduced. Consequently, the operating comfort to the user is enhanced.

5 Claims, 20 Drawing Sheets

KEYBOARD DEVICE

FIELD OF THE INVENTION

The present invention relates to an input device, and more particularly to a keyboard device.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users and most manufacturers of input devices pay much attention to the development of keyboard devices.

The structures and the functions of a conventional keyboard device 1 will be illustrated as follows. Please refer to FIGS. 1, 2 and 3. FIG. 1 is a schematic top view illustrating the outer appearance of a conventional keyboard device. FIG. 2 is a schematic exploded view illustrating a portion of the keyboard device of FIG. 1 and taken along a viewpoint. FIG. 3 is a schematic exploded view illustrating a portion of the keyboard device of FIG. 1 and taken along another viewpoint. For succinctness, only one key 10' and related components are shown in FIGS. 2 and 3.

The conventional keyboard device 1 comprises plural keys 10 and 10', a base plate 11 and a membrane circuit board 12. The membrane circuit board 12 comprises plural membrane switches 121 corresponding to the plural keys 10 and 10'. Each of the plural keys 10 and 10' comprises a keycap 101, at least one scissors-type connecting element 102 and an elastic element 103. The scissors-type connecting element 102 is connected between the keycap 101 and the base plate 11. Moreover, the scissors-type connecting element 102 comprises a first frame 1021 and a second frame 1022. The second frame 1022 is pivotally coupled to the first frame 1021. Consequently, the first frame 1021 and the second frame 1022 can be swung relative to each other. The elastic element 103 is arranged between the keycap 101 and the base plate 11. Moreover, the elastic element 103 comprises a contacting part 1031.

While the keycap 101 of any key 10 or 10' is depressed and moved downwardly relative to the base plate 11, the first frame 1021 and the second frame 1022 of the scissors-type connecting element 102 are switched from an open-scissors state to a stacked state. Moreover, as the keycap 101 is moved downwardly to compress the elastic element 103, the corresponding membrane switch 121 is pushed and triggered by the contacting part 1031 of the elastic element 103. Consequently, the keyboard device 1 generates a corresponding key signal. When the keycap 101 of the key 10 or 10' is no longer depressed, the keycap 101 is moved upwardly relative to the base plate 11 in response to an elastic force of the elastic element 103. Meanwhile, the first frame 1021 and the second frame 1022 are switched from the stacked state to the open-scissors state again, and the keycap 101 is returned to its original position.

As shown in the drawings, the length L1 of the key 10' is much larger than the width W1 of the key 10'. The key 10' further comprises two stabilizer bars 104. Each stabilizer bar 104 comprises a transverse bar part 1041 and two hook parts 1042. The two hook parts 1042 are located at two ends of the transverse bar part 1041, respectively.

The base plate 11 comprises a first connecting structure 111 and a second connecting structure 112. The first connecting structure 111 and the second connecting structure 112 are protruded upwardly, and penetrated through the membrane circuit board 12. The first connecting structure 111 comprises two first locking holes 1111. The second connecting structure 112 comprises two second locking holes 1121 corresponding to the two first locking holes 1111.

The transverse bar part 1041 of the stabilizer bar 104 is pivotally coupled to the keycap 101 of the key 10'. The two hook parts 1042 of the stabilizer bar 104 are penetrated through the corresponding first locking hole 1111 of the first connecting structure 111 and the corresponding second locking hole 1121 of the second connecting structure 112, respectively.

FIG. 4 schematically illustrates the actions of the stabilizer bar of the keyboard device as shown in FIG. 1. While the keycap 101 of the key 10' is moved upwardly or downwardly relative to the base plate 11, the stabilizer bar 104 is moved in the direction D11 or the direction D12 and rotated in the direction D13 or the direction D14. By this design, the key 10' is kept stable and not inclined while the key 10' is moved upwardly or downwardly relative to the base plate 11. Moreover, this design is helpful to increase the strength of the keycap 101.

However, the conventional keyboard device 1 still has some drawbacks. While the keycap 101 of the key 10' is depressed and moved downwardly relative to the base plate 11, the two first hook parts 1042 of the stabilizer bar 104 readily collide with or knock on the base plate 11, the first connecting structure 111 and the second connecting structure 112. Since all of the stabilizer bar 104, the base plate 11, the first connecting structure 111 and the second connecting structure 112 are made of metallic material, the above actions between the metallic components result in the collision sound or the click sound. The collision sound or the click is unpleasant noise to the user.

In other words, the conventional keyboard device needs to be further improved.

SUMMARY OF THE INVENTION

An object of the present invention provides a keyboard device having a function of reducing noise. A stabilizer bar of a key is connected between a keycap and a connecting element of the key. Since the stabilizer bar does not readily collide with or knock on a plate body and a base coupling structure of a base plate, the generated noise is reduced during the process of operating the key. Consequently, the operating comfort to the user is enhanced.

In accordance with an aspect of the present invention, there is provided a keyboard device. The keyboard device includes a membrane circuit board, a base plate and a key. The membrane circuit board includes a membrane switch. The base plate includes a plate body and a base coupling structure. The plate body is located under the membrane circuit board. The base coupling structure is protruded upwardly and penetrated through the membrane circuit board. The key includes a keycap, a connecting element and a stabilizer bar. The keycap is located over the membrane circuit board. When the keycap is moved downwardly relative to the membrane circuit board, the membrane switch is triggered. The connecting element is connected between the keycap and the base plate. The stabilizer bar is connected between the keycap and the connecting element. While the keycap is moved upwardly or downwardly relative to the base plate, the stabilizer bar is swung to stabilize the key.

In accordance with another aspect of the present invention, there is provided a keyboard device. The keyboard device includes a membrane circuit board, a base plate and a key. The membrane circuit board includes a membrane switch. The base plate includes a plate body and a base coupling structure. The plate body is located under the membrane circuit board. The base coupling structure is protruded upwardly and penetrated through the membrane circuit board. The keycap includes a keycap, a first connecting element, a second connecting element and a stabilizer bar. The keycap is located over the membrane circuit board. When the keycap is moved downwardly relative to the membrane circuit board, the membrane switch is triggered. The first connecting element is connected between the keycap and the base plate. The second connecting element is connected between the keycap and the base plate. The stabilizer bar includes a transverse bar part, a first hook part and a second hook part. The first hook part and the second hook part are respectively located at two ends of the transverse bar part. The transverse bar part is connected with the keycap. The first hook part is connected with the first connecting element. The second hook part is connected with the second connecting element. While the keycap is moved upwardly or downwardly relative to the base plate, the stabilizer bar is swung to stabilize the key.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
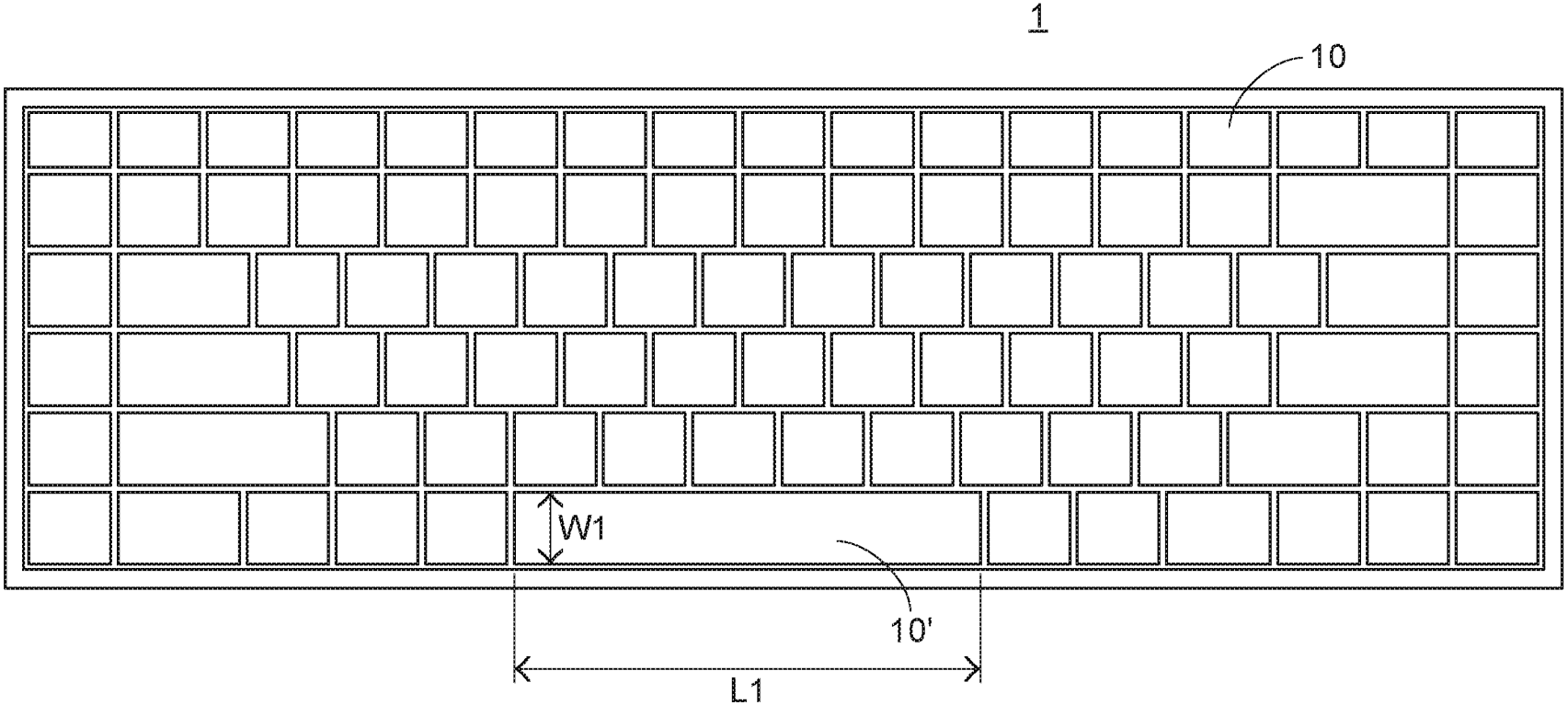
FIG.1 PRIOR ART
FIG. 1 is a schematic top view illustrating the outer appearance of a conventional keyboard device.
Figure 2:
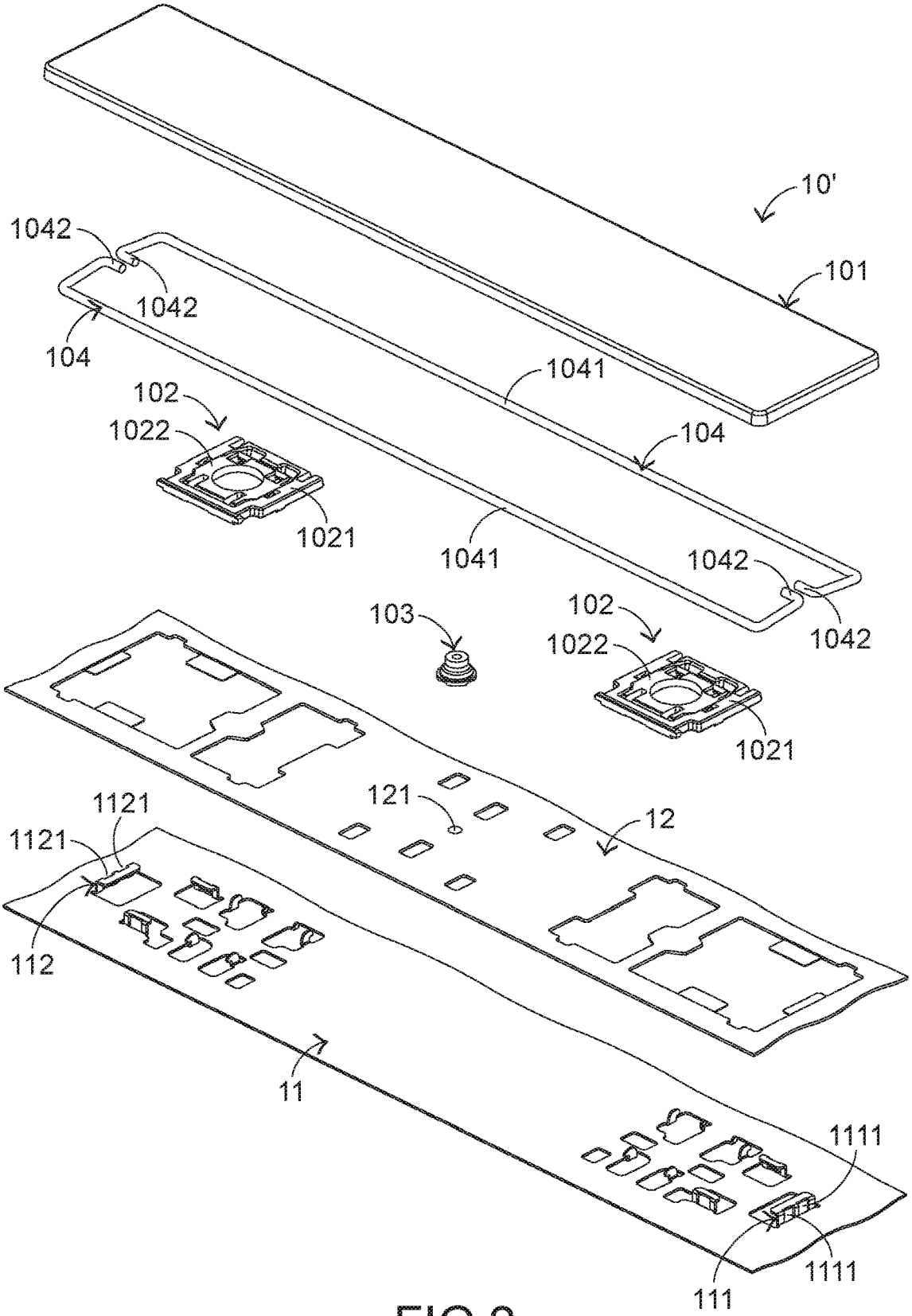
FIG.2 PRIOR ART
FIG. 2 is a schematic exploded view illustrating a portion of the keyboard device of FIG. 1 and taken along a viewpoint.
Figure 3:
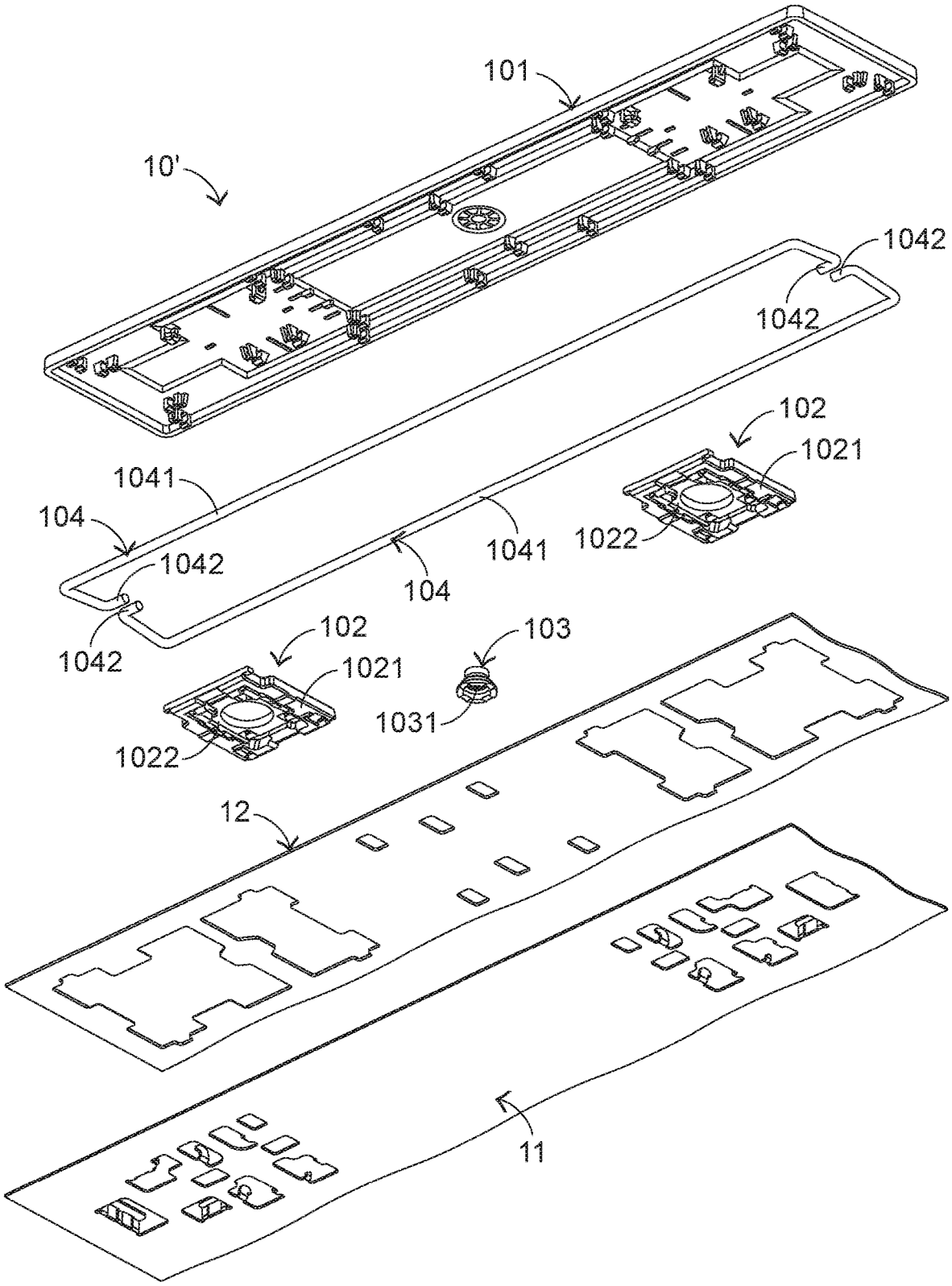
FIG.3 PRIOR ART
FIG. 3 is a schematic exploded view illustrating a portion of the keyboard device of FIG. 1 and taken along another viewpoint.
Figure 4:
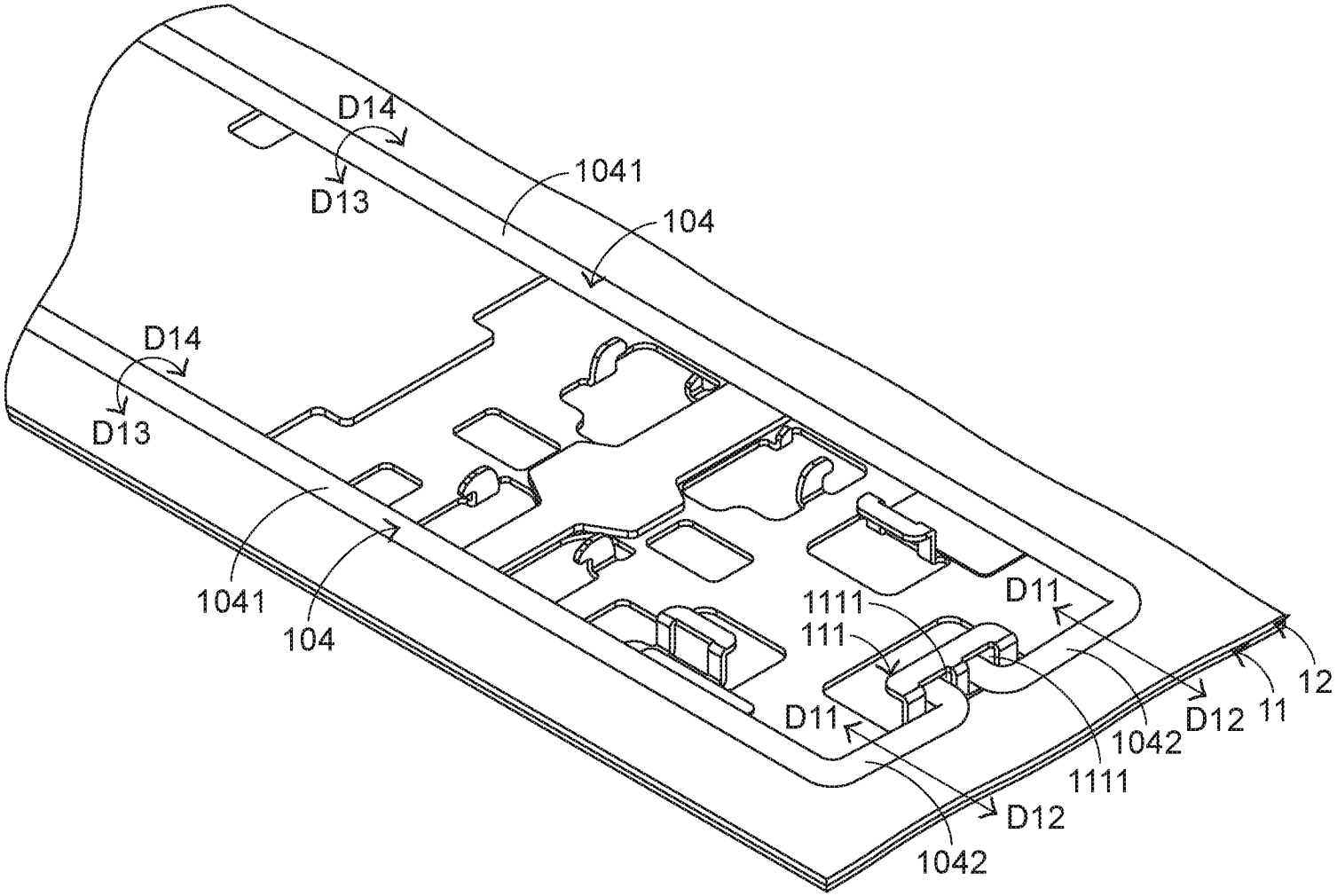
FIG.4 PRIOR ART
FIG. 4 schematically illustrates the actions of the stabilizer bar of the keyboard device as shown in FIG. 1.
Figure 5:
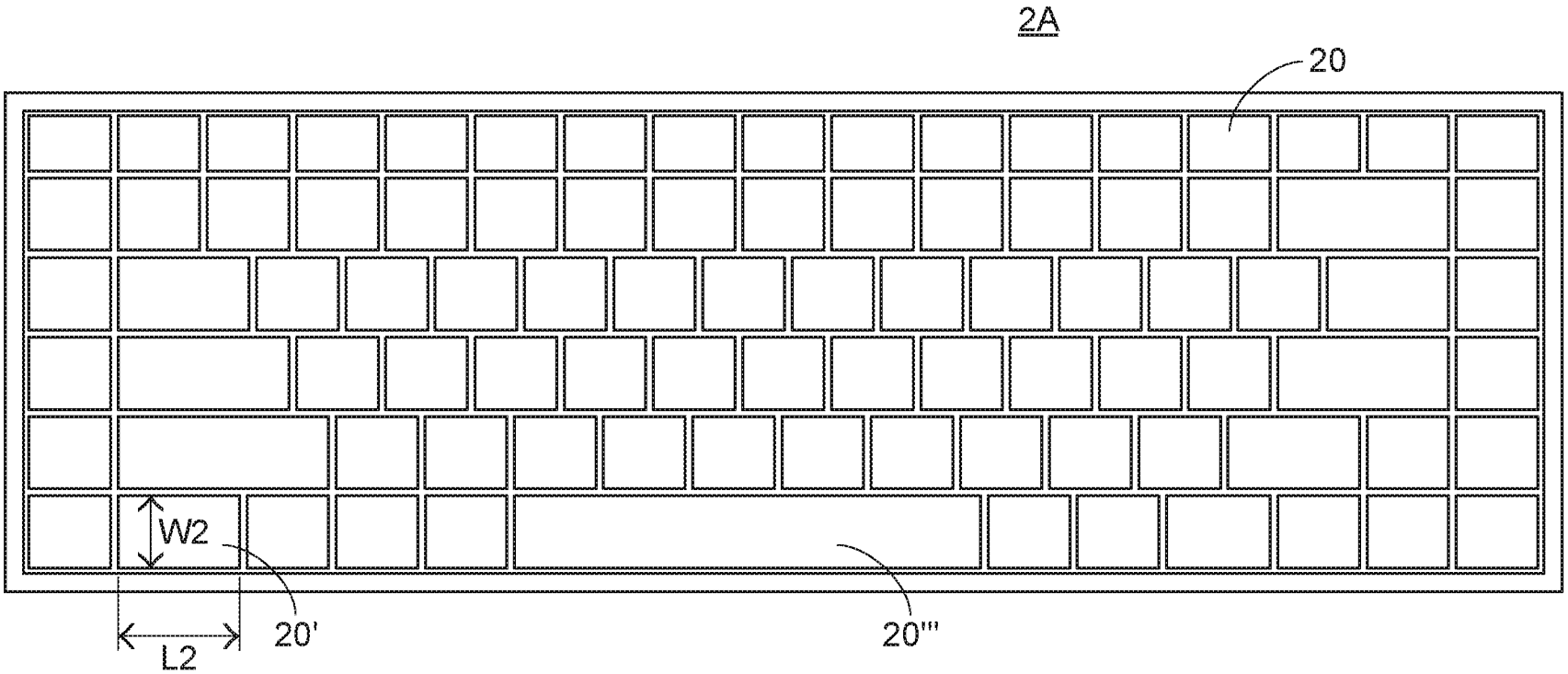
FIG. 5 is a schematic top view illustrating the outer appearance of a keyboard device according to a first embodiment of the present invention.
Figure 6:
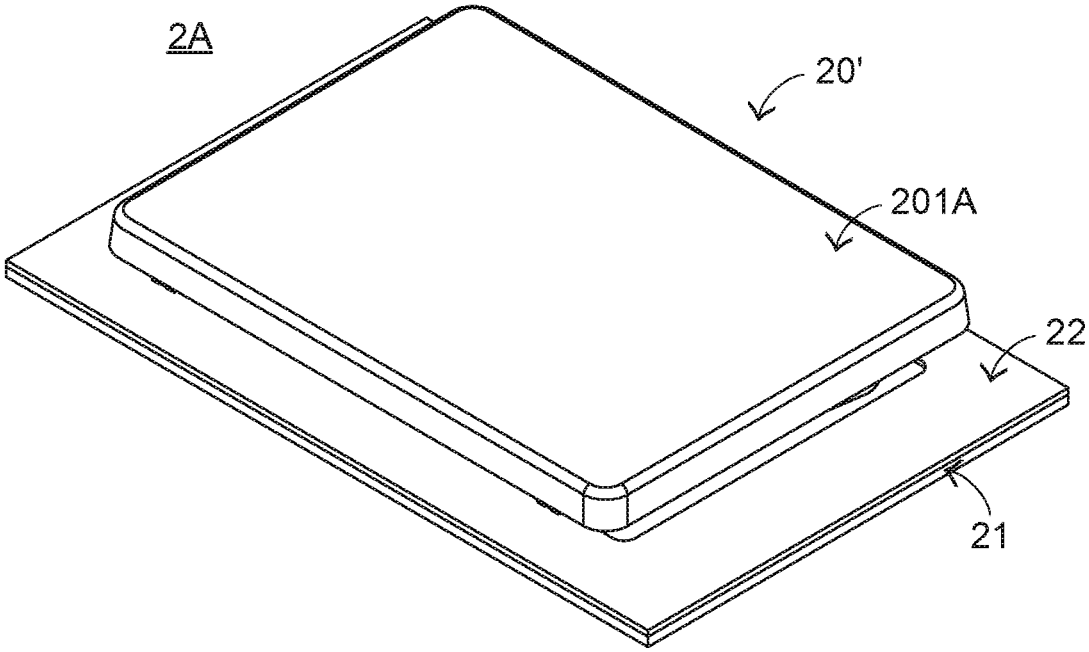
FIG. 6 is a schematic perspective view illustrating a portion of the keyboard device of FIG. 5.
Figure 7:
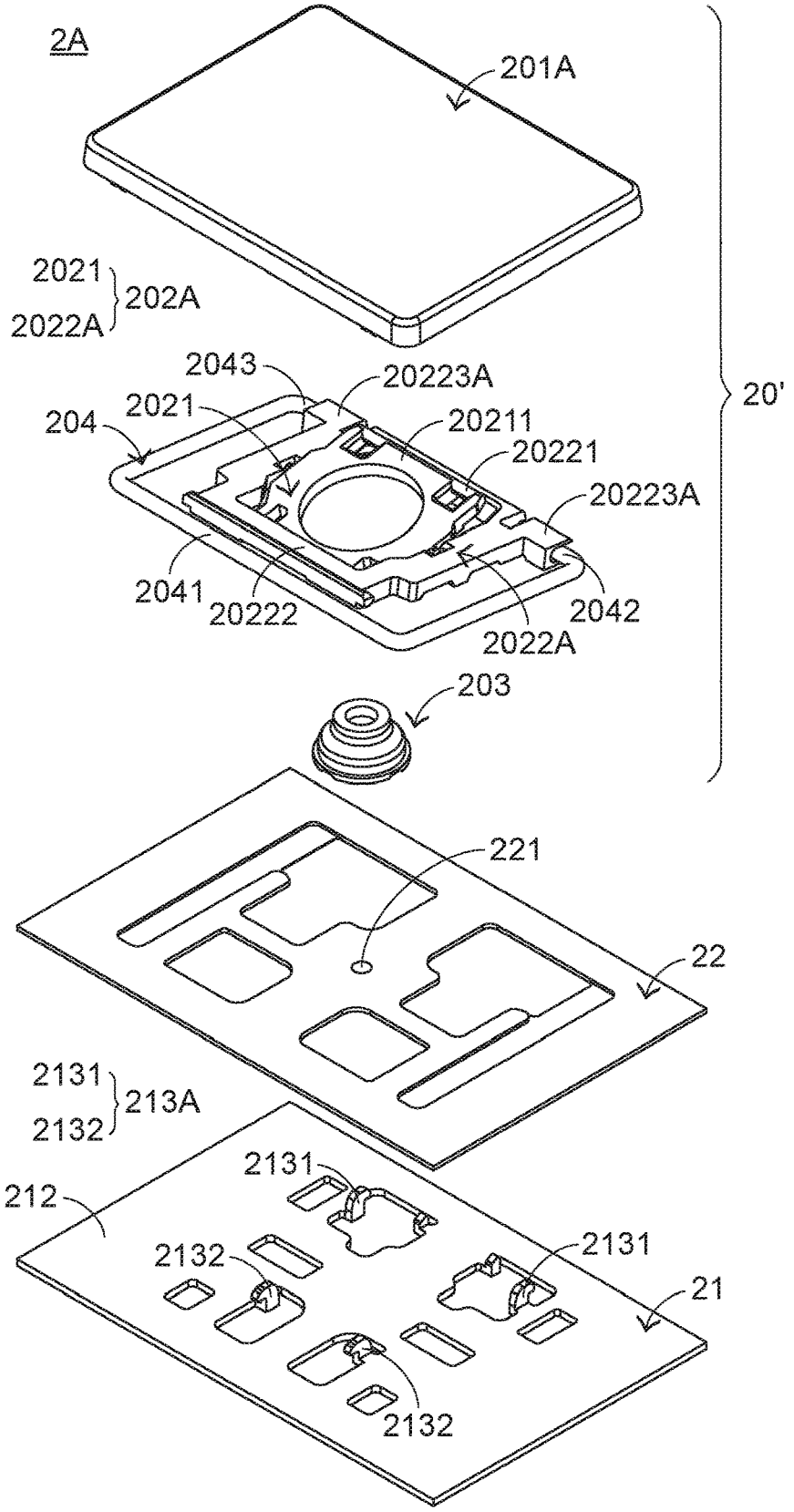
FIG. 7 is a schematic exploded view illustrating a portion of the keyboard device of FIG. 6 and taken along a viewpoint.
Figure 8:
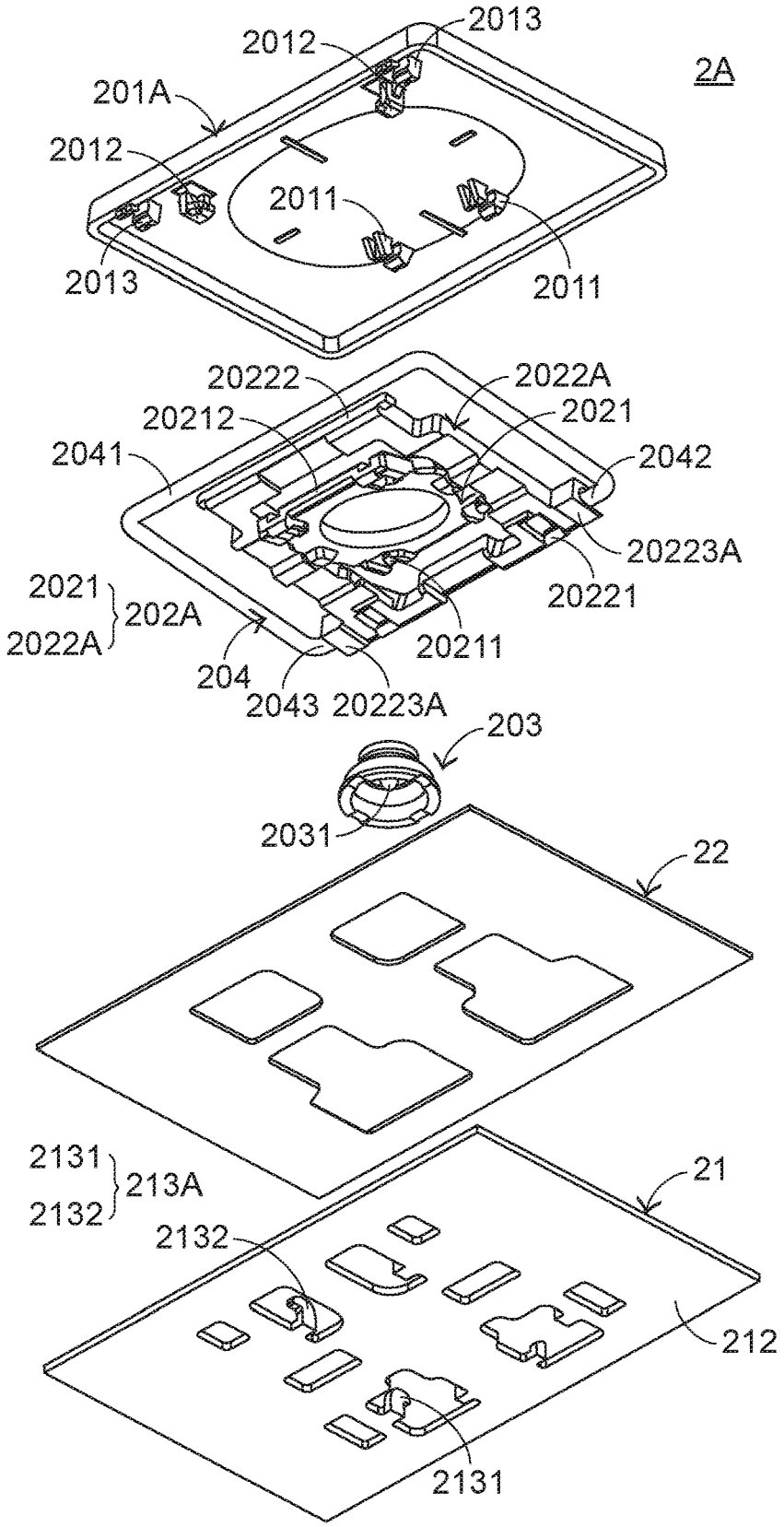
FIG. 8 is a schematic exploded view illustrating a portion of the keyboard device of FIG. 6 and taken along another viewpoint.

Please refer to FIGS. 5, 6, 7 and 8. FIG. 5 is a schematic top view illustrating the outer appearance of a keyboard device according to a first embodiment of the present invention. FIG. 6 is a schematic perspective view illustrating a portion of the keyboard device of FIG. 5. FIG. 7 is a schematic exploded view illustrating a portion of the keyboard device of FIG. 6 and taken along a viewpoint. FIG. 8 is a schematic exploded view illustrating a portion of the keyboard device of FIG. 6 and taken along another viewpoint. For succinctness, only one key 20' and related components are shown in FIGS. 6, 7 and 8.

The keyboard device 2A comprises plural keys 20 and 20', a base plate 21 and a membrane circuit board 22. The membrane circuit board 22 is arranged between the plural keys 20, 20' and the base plate 21. These keys 20 and 20' are classified into some types, e.g., ordinary keys, numeric keys and function keys. When one of the keys 20 and 20' is depressed by the user's finger, the keyboard device 2A generates a corresponding key signal to a computer (not show), and thus the computer executes a function corresponding to the depressed key. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

The base plate 21 comprises a plate body 212 and plural base coupling structures 213A. The plate body 212 is located under the membrane circuit board 22. The base coupling structures 213A are protruded upwardly and penetrated through the membrane circuit board 22. The membrane circuit board 22 comprises plural membrane switches 221 corresponding to the keys 20 and 20'.

Each of the plural keys 20 and 20' comprises a keycap 201A, a connecting element 202A and an elastic element 203. The connecting element 202A is connected between the keycap 201A and the corresponding base coupling structure 213A of the base plate 21. Through the connecting element 202A, the keycap 201A is moved upwardly or downwardly relative to the base plate 21. The elastic element 203 is arranged between the keycap 201A and the membrane circuit board 22. Moreover, the elastic element 203 comprises a contacting part 2031.

In an embodiment, the keycap 201A comprises plural first keycap connecting parts 2011 and plural second keycap connecting parts 2012. The first keycap connecting parts 2011 and the second keycap connecting parts 2012 are formed on a bottom surface of the keycap 201A. In an embodiment, the first keycap connecting parts 2011 are fixed-type hooks, and the second keycap connecting parts 2012 are moving-type hooks. The connecting element 202A is a scissors-type connecting element. Moreover, the connecting element 202A comprises a first frame 2021 and a second frame 2022A. The second frame 2022A is pivotally coupled to the first frame 2021. For example, the first frame 2021 is an inner frame, and the second frame 2022A is an outer frame.

The base coupling structure 213A comprises a first base connecting part 2131 and a second base connecting part 2132. In an embodiment, the first base connecting part 2131 is a first base hook, and the second base connecting part 2132 is a second base hook. A first end 20211 of the first frame 2021 is connected with the first keycap connecting part 2011 of the keycap 201A. A second end 20212 of the first frame 2021 is connected with the second base connecting part 2132 of the base plate 21. A first end 20221 of the second frame 2022A is connected with the first base connecting part 2131 of the base plate 21. A second end 20222 of the second frame 2022A is connected with the second keycap connecting parts 2012 of the keycap 201A. Due to above design, the first frame 2021 and the second frame 2022A can be swung relative to each other. That is, the first frame 2021 and the second frame 2022A are switched from an open-scissors state to a stacked state or switched from the stacked state to the open-scissors state. The connecting relationships between the connecting element 202A, the base plate 21 and the keycap 201A are presented herein for purpose of illustration and description only.

While the keycap 201A of any key 20 or 20' is depressed and moved downwardly relative to the base plate 21, the first frame 2021 and the second frame 2022A of the connecting element 202A are switched from the open-scissors state to the stacked state. Moreover, as the keycap 201A is moved downwardly to compress the elastic element 203, the corresponding membrane switch 221 is pushed and triggered by the contacting part 2031 of the elastic element 203. Consequently, the keyboard device 2A generates a corresponding key signal. When the keycap 201A of the key 20 or 20' is no longer depressed, the keycap 201A is moved upwardly relative to the base plate 21 in response to an elastic force of the elastic element 203. Meanwhile, the first frame 2021 and the second frame 2022A are switched from the stacked state to the open-scissors state again, and the keycap 201A is returned to its original position.

As shown in FIGS. 5, 6, 7 and 8, the length L2 of the key 20' is much larger than the width W2 of the key 20'. The key 20' further comprises a stabilizer bar 204. The stabilizer bar 204 is connected between the keycap 201A and the connecting element 202A. Preferably but not exclusively, the stabilizer bar 204 is made of metallic material. In this embodiment, the keycap 201A further comprises a keycap coupling part 2013. The keycap coupling part 2013 is formed on the bottom surface of the keycap 201A. Moreover, two frame sliding grooves 20223A are formed in two lateral sides of the first end 20221 of the second frame 2022A, respectively. The stabilizer bar 204 comprises a transverse bar part 2041, a first hook part 2042 and a second hook part 2043. The first hook part 2042 and the second hook part 2043 are located at two ends of the transverse bar part 2041, respectively. The transverse bar part 2041 of the stabilizer bar 204 is pivotally coupled to the keycap coupling part 2013 of the keycap 201A. The first hook part 2042 and the second hook part 2043 of the stabilizer bar 204 are inserted into the two frame sliding grooves 20223A of the second frame 2022A, respectively.

Figure 9A:
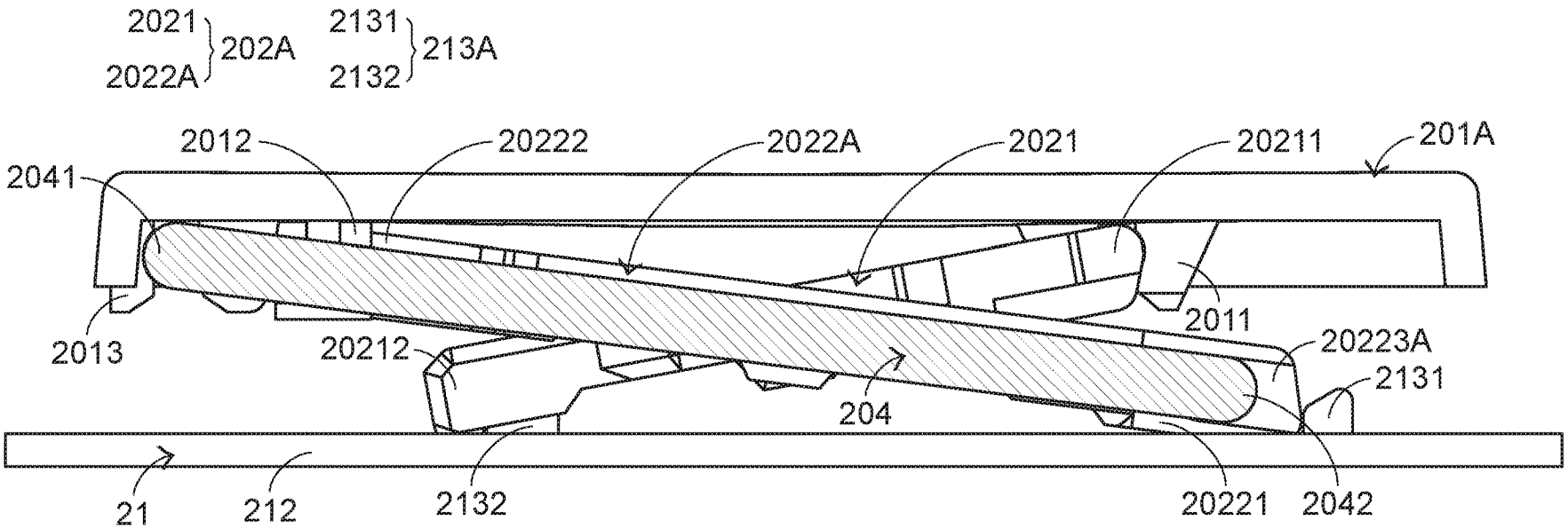
FIG. 9A is a schematic cross-sectional view illustrating a portion of the keyboard device of FIG. 6, in which the keycap is not depressed.
Figure 9B:
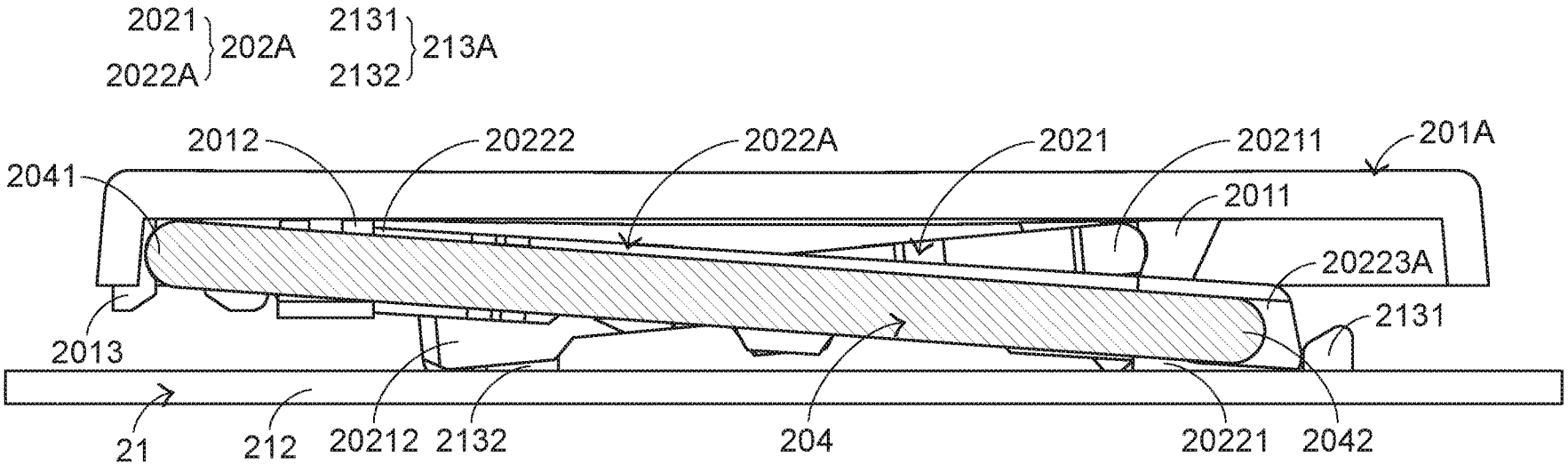
FIG. 9B is a schematic cross-sectional view illustrating a portion of the keyboard device of FIG. 6, in which the keycap is partially depressed.
Figure 9C:
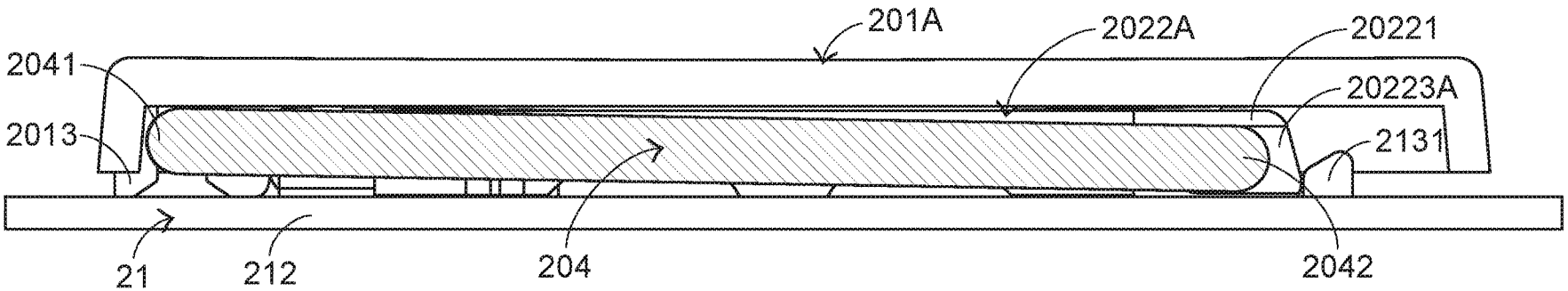
FIG. 9C is a schematic cross-sectional view illustrating a portion of the keyboard device of FIG. 6, in which the keycap is completely depressed.

Please refer to FIGS. 9A, 9B and 9C. FIG. 9A is a schematic cross-sectional view illustrating a portion of the keyboard device of FIG. 6, in which the keycap is not depressed. FIG. 9B is a schematic cross-sectional view illustrating a portion of the keyboard device of FIG. 6, in which the keycap is partially depressed. FIG. 9C is a schematic cross-sectional view illustrating a portion of the keyboard device of FIG. 6, in which the keycap is completely depressed. For succinctness, the membrane circuit board 22, the elastic element 203 and the related components are not shown in FIGS. 9A, 9B and 9C. While the keycap 201A of the key 20' is depressed and moved upwardly or downwardly relative to the base plate 21, the actions of the connecting element 202A are similar to those as mentioned above. In addition, the transverse bar part 2041 of the stabilizer bar 204 is pivotally coupled to the keycap coupling part 2013 of the keycap 201A, and the first hook part 2042 and the second hook part 2043 of the stabilizer bar 204 are moved within the two frame sliding grooves 20223A of the second frame 2022A, respectively. Consequently, the stabilizer bar 204 is swung. By this design, the key 20' is kept stable and not inclined while the key 20' is moved upwardly or downwardly relative to the base plate 21. Moreover, this design is helpful to increase the strength of the keycap 201A.

Figure 10:
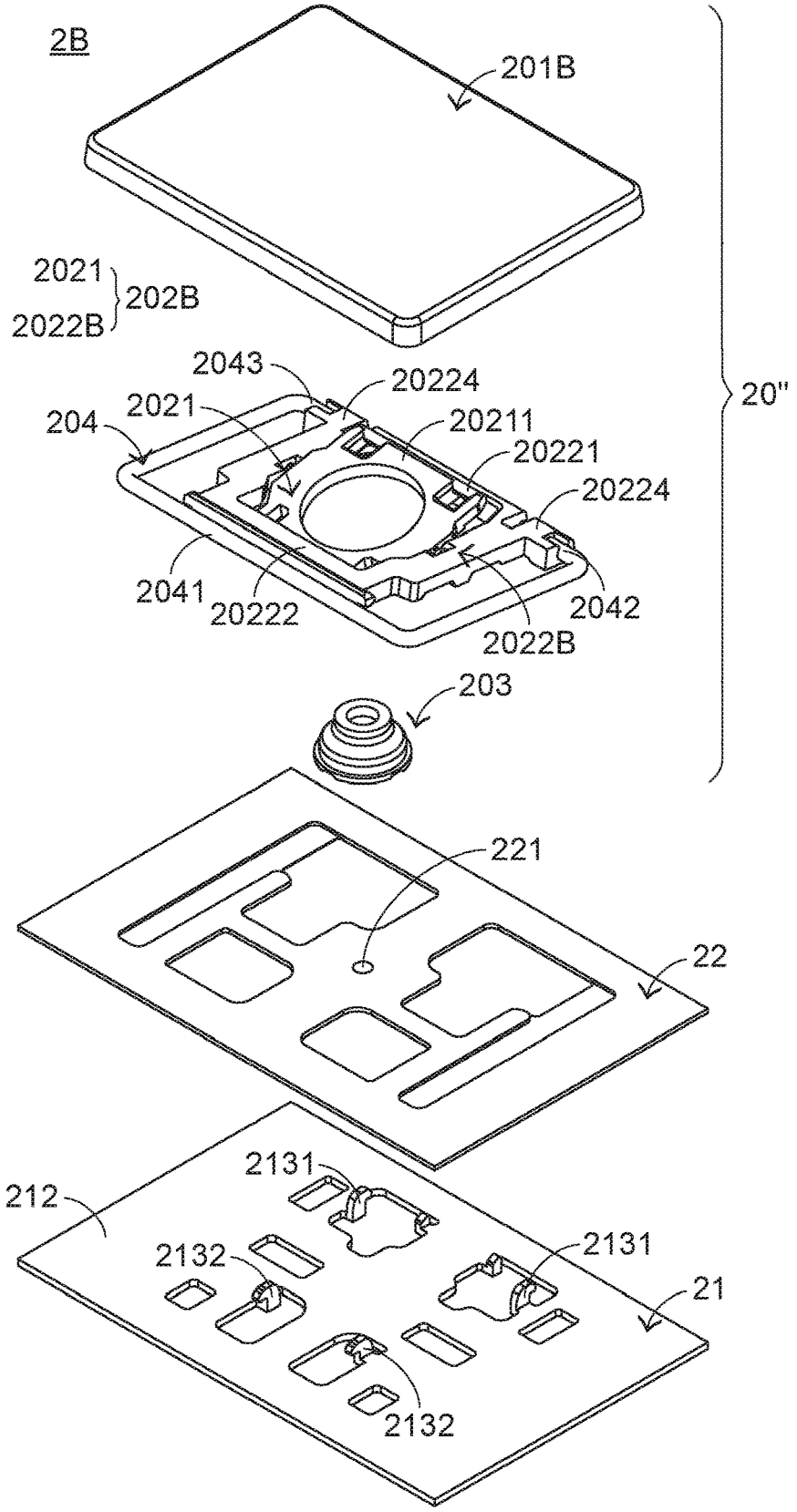
FIG. 10 is a schematic exploded view illustrating a portion of a keyboard device according to a second embodiment and taken along a viewpoint.
Figure 11:
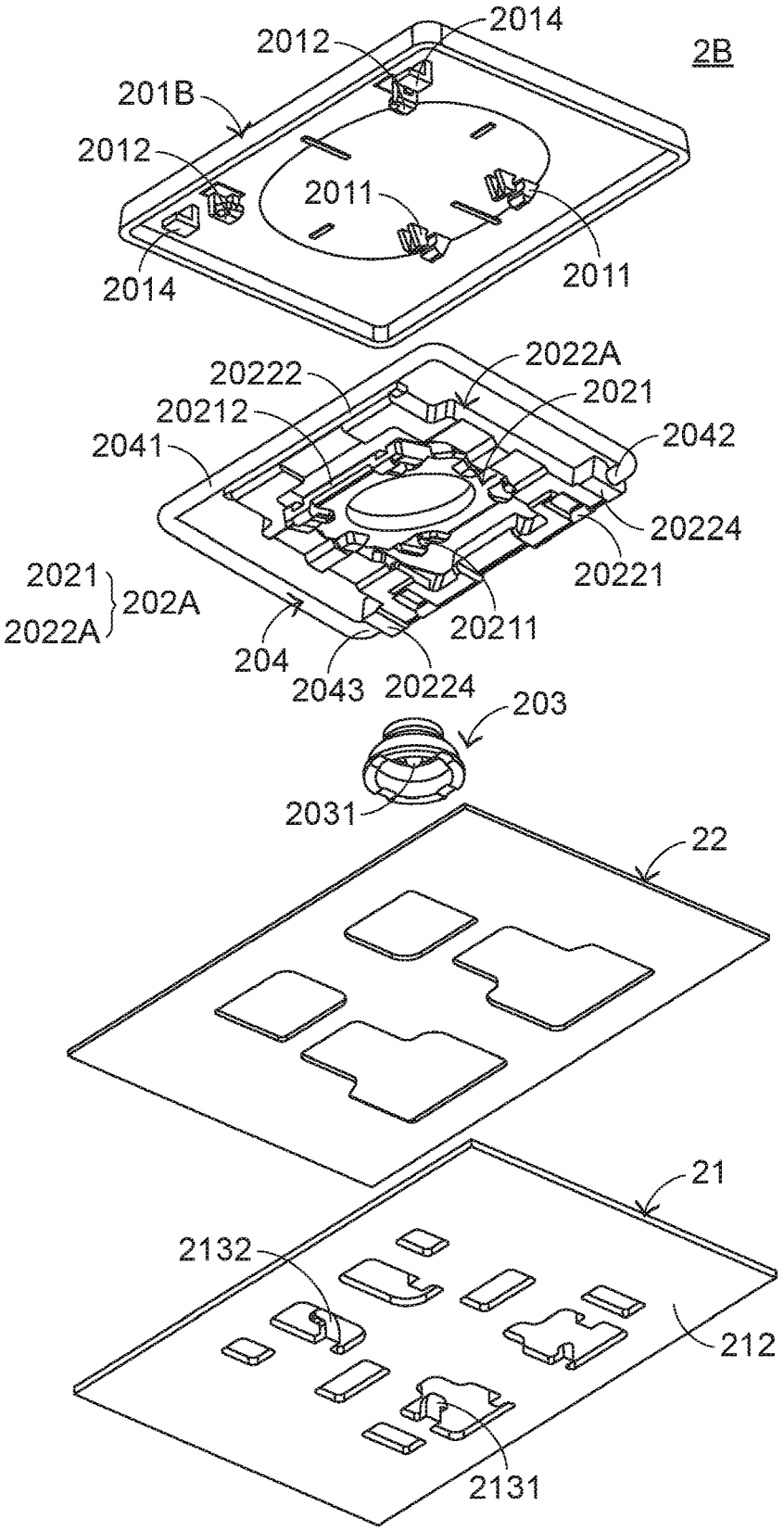
FIG. 11 is a schematic exploded view illustrating a portion of the keyboard device of FIG. 10 and taken along another viewpoint.

Please refer to FIGS. 10 and 11. FIG. 10 is a schematic exploded view illustrating a portion of a keyboard device according to a second embodiment and taken along a viewpoint. FIG. 11 is a schematic exploded view illustrating a portion of the keyboard device of FIG. 10 and taken along another viewpoint. For succinctness, only one key 20" and related components of the keyboard device 2B are shown in FIGS. 10 and 11. The components of the keyboard device 2B that are similar to those of the first embodiment are not redundantly described herein. In comparison with the first embodiment, the keyboard device 2B of this embodiment is distinguished by the following aspects. For example, two keycap sliding grooves 2014 are formed on the bottom surface of the keycap 201B to replace the keycap coupling parts 2013 of the first embodiment. Moreover, two frame coupling parts 20224 are respectively located at two lateral sides of the first end 20221 of the second frame 2022B to replace the frame sliding grooves 20223A of the first embodiment. In this embodiment, the transverse bar part 2041 of the stabilizer bar 204 is connected with the keycap sliding grooves 2014 of the keycap 201B. The first hook part 2042 and the second hook part 2043 of the stabilizer bar 204 are respectively inserted into the two frame coupling parts 20224 of the second frame 2022B so as to be pivotally coupled to the two frame coupling parts 20224.

Figure 12A:
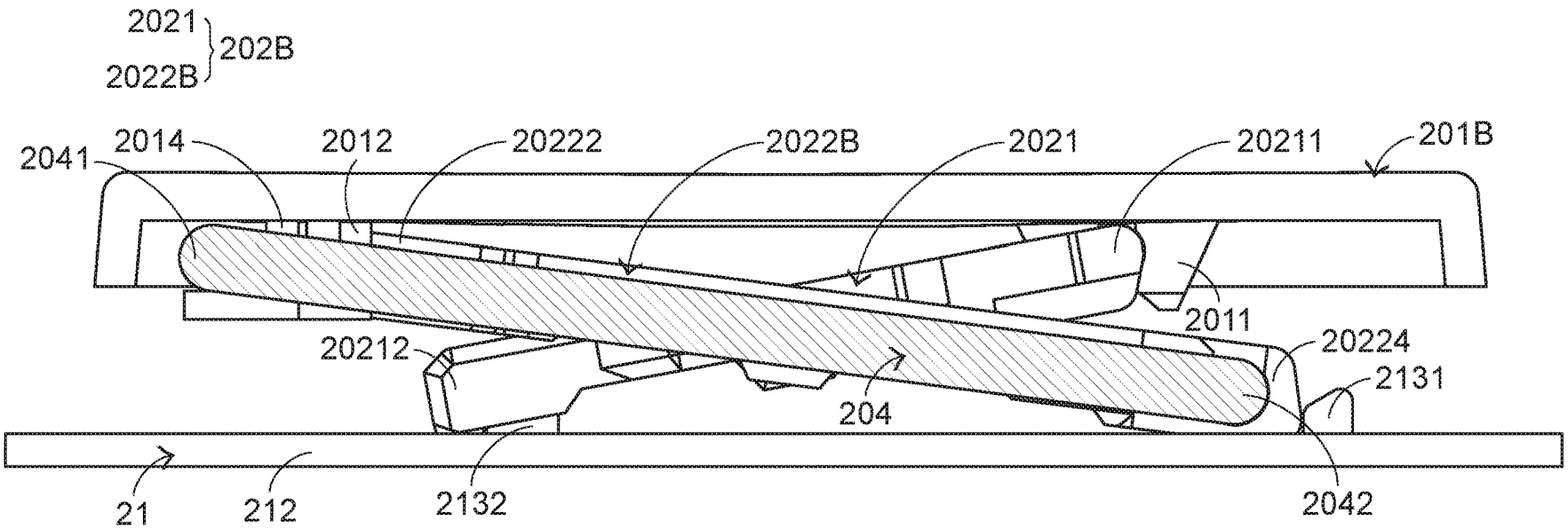
FIG. 12A is a schematic cross-sectional view illustrating a portion of the keyboard device of FIG. 10, in which the keycap is not depressed.
Figure 12B:
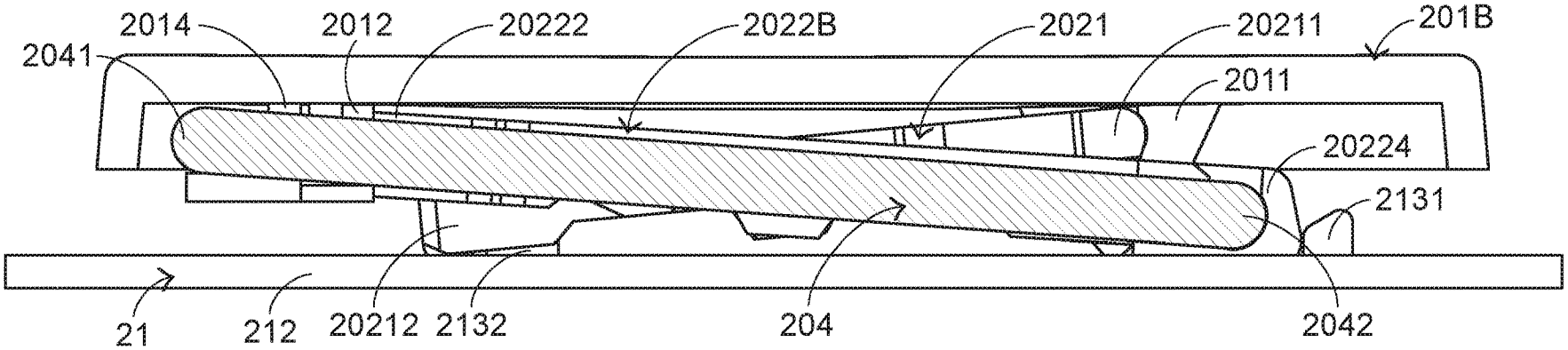
FIG. 12B is a schematic cross-sectional view illustrating a portion of the keyboard device of FIG. 10, in which the keycap is partially depressed.
Figure 12C:
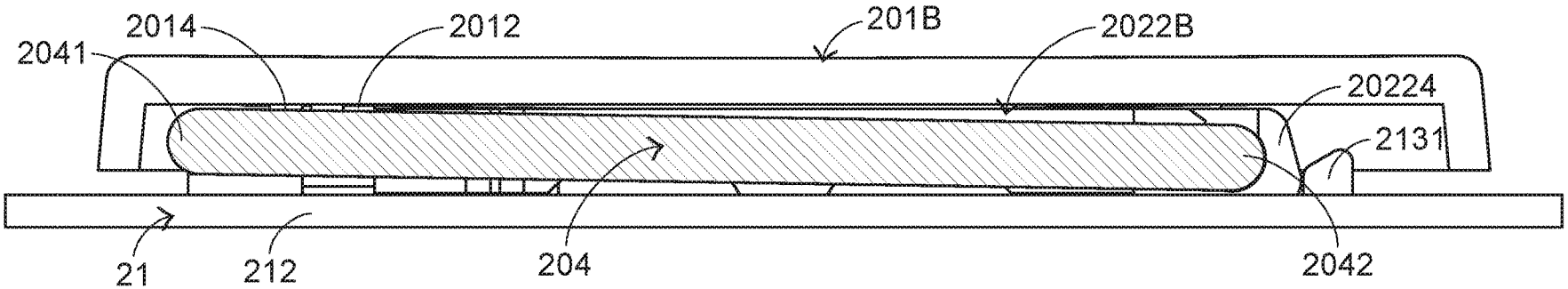
FIG. 12C is a schematic cross-sectional view illustrating a portion of the keyboard device of FIG. 10, in which the keycap is completely depressed.

Please refer to FIGS. 12A, 12B and 12C. FIG. 12A is a schematic cross-sectional view illustrating a portion of the keyboard device of FIG. 10, in which the keycap is not depressed. FIG. 12B is a schematic cross-sectional view illustrating a portion of the keyboard device of FIG. 10, in which the keycap is partially depressed. FIG. 12C is a schematic cross-sectional view illustrating a portion of the keyboard device of FIG. 10, in which the keycap is completely depressed. For succinctness, the membrane circuit board 22, the elastic element 203 and the related components are not shown in FIGS. 12A, 12B and 12C. While the keycap 201B of the key 20" is depressed and moved upwardly or downwardly relative to the base plate 21, the actions of the connecting element 202B are similar to those as mentioned in the first embodiment. The first hook part 2042 and the second hook part 2043 of the stabilizer bar 204 are pivotally coupled to the two frame coupling parts 20224 of the second frame 2022B, respectively. In addition, the transverse bar part 2041 of the stabilizer bar 204 is moved within the keycap sliding grooves 2014 of the keycap 201B. Consequently, the stabilizer bar 204 is swung. By this design, the key 20" is kept stable and not inclined while the key 20" is moved upwardly or downwardly relative to the base plate 21. Moreover, this design is helpful to increase the strength of the keycap 201B.

Figure 13:
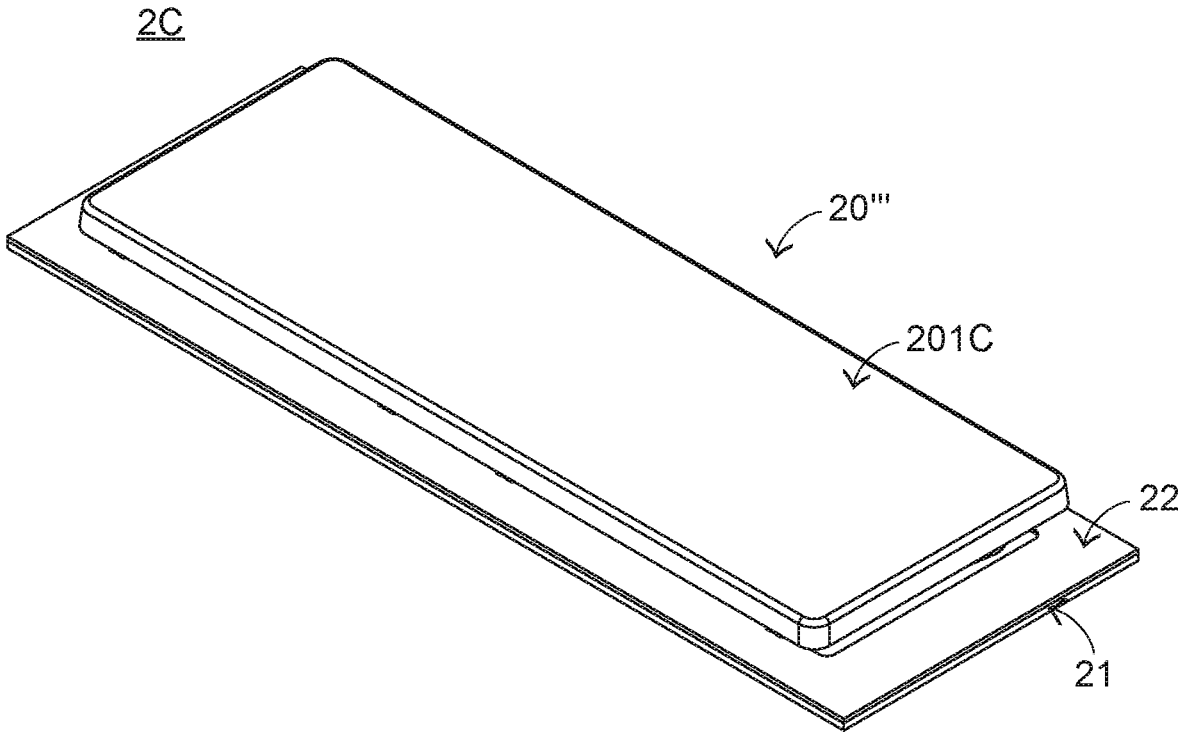
FIG. 13 is a schematic perspective view illustrating the outer appearance of a keyboard device according to a third embodiment of the present invention.
Figure 14:
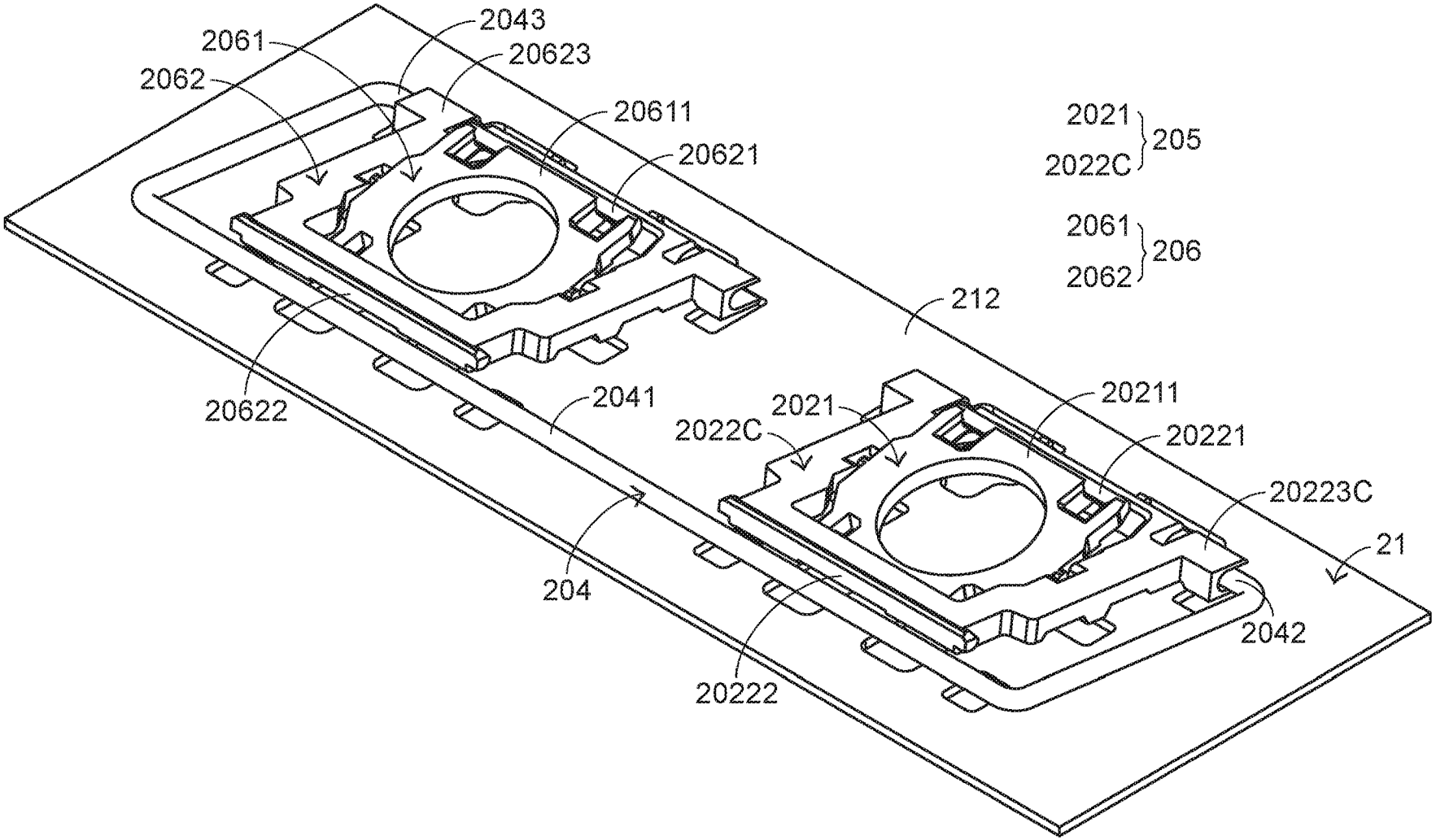
FIG. 14 is a schematic perspective view illustrating a portion of the keyboard device of FIG. 13.
Figure 15:
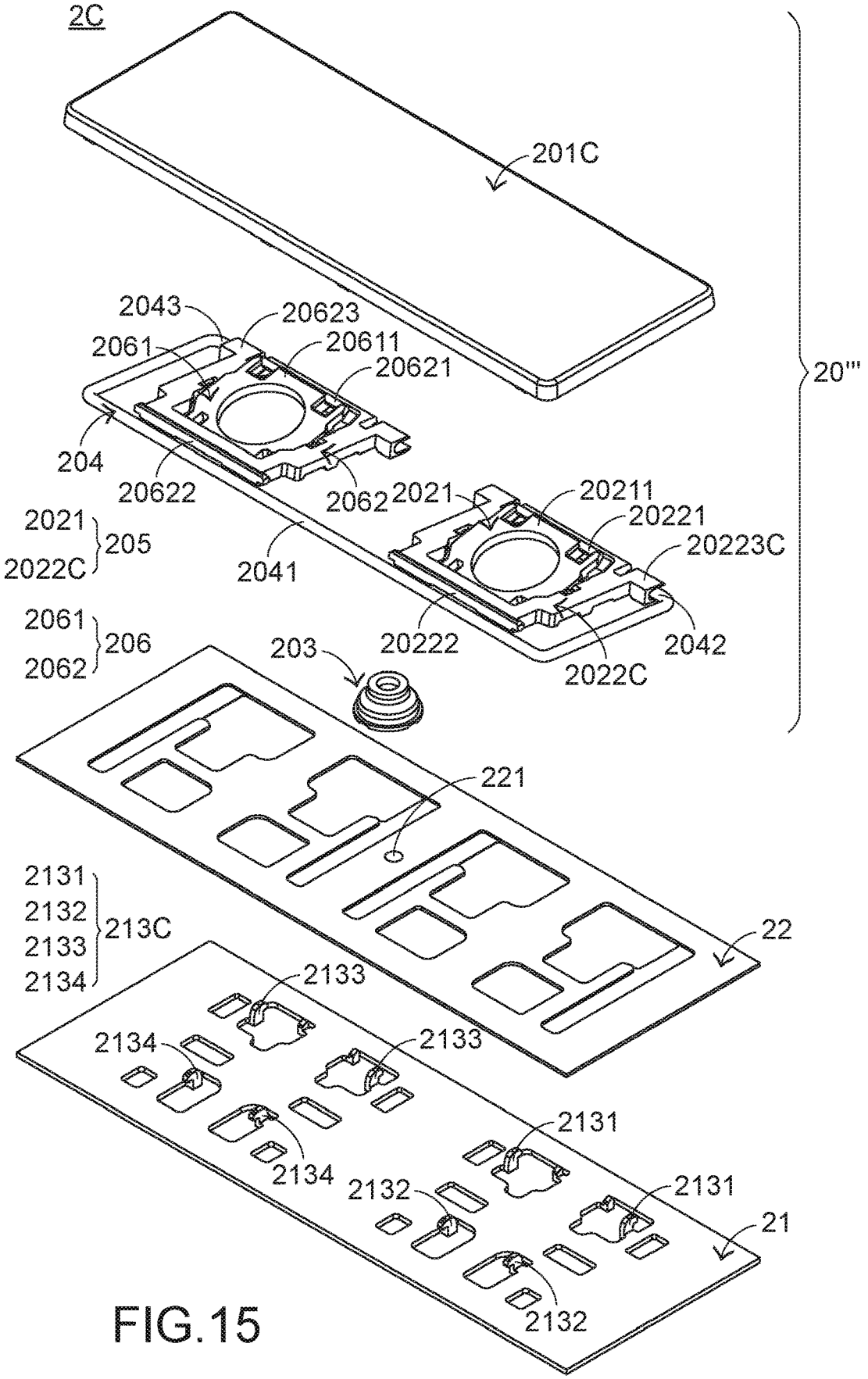
FIG. 15 is a schematic exploded view illustrating a portion of the keyboard device of FIG. 13 and taken along a viewpoint.
Figure 16:
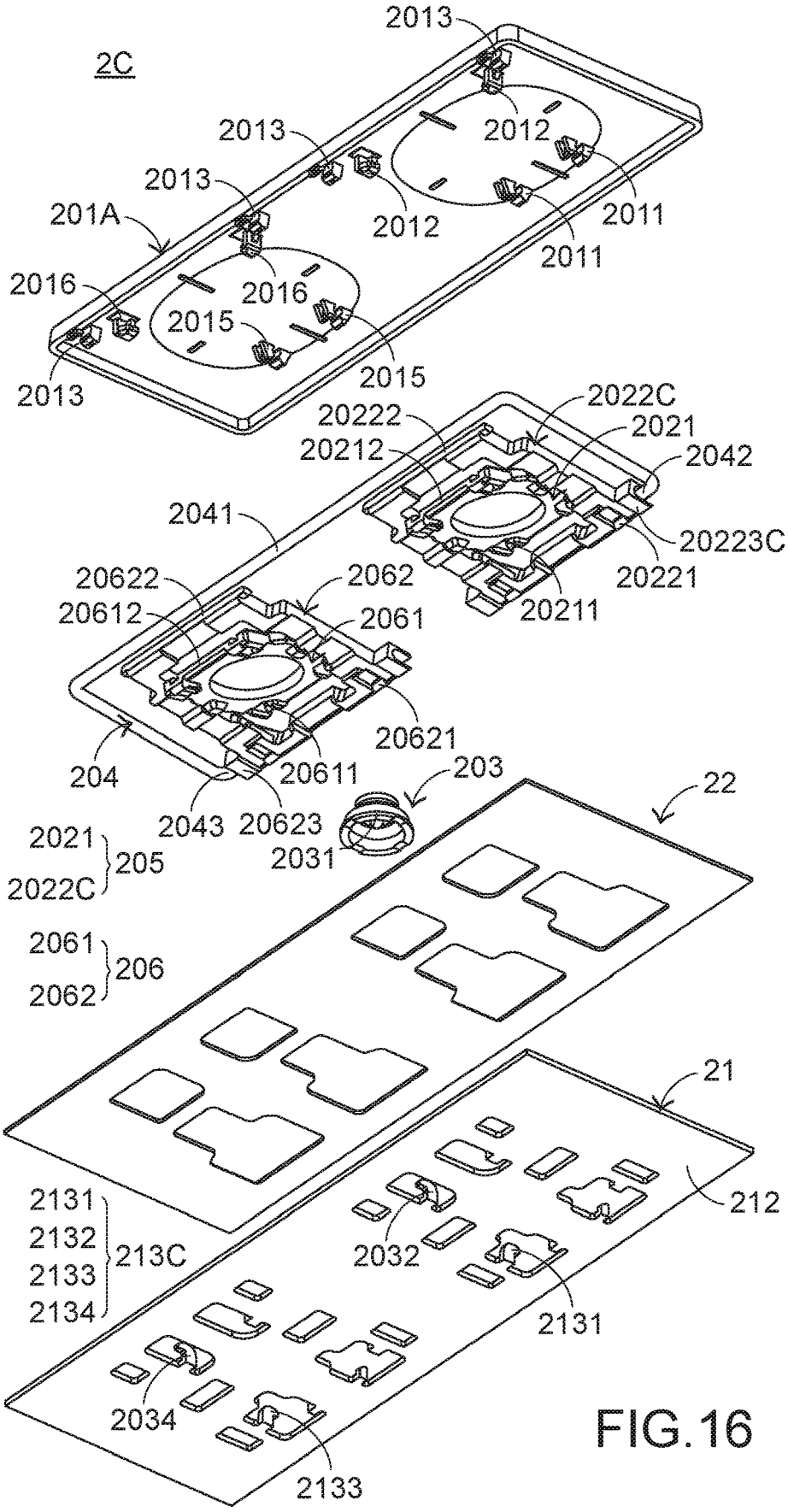
FIG. 16 is a schematic exploded view illustrating a portion of the keyboard device of FIG. 13 and taken along another viewpoint.

Please refer to FIGS. 13, 14, 15 and 16. FIG. 13 is a schematic perspective view illustrating the outer appearance of a keyboard device according to a third embodiment of the present invention. FIG. 14 is a schematic perspective view illustrating a portion of the keyboard device of FIG. 13. FIG. 15 is a schematic exploded view illustrating a portion of the keyboard device of FIG. 13 and taken along a viewpoint. FIG. 16 is a schematic exploded view illustrating a portion of the keyboard device of FIG. 13 and taken along another viewpoint. For succinctness, only one key 20''' and related components are shown in FIGS. 13, 14, 15 and 16. The components of the keyboard device 2C that are similar to those of the first embodiment are not redundantly described herein. In comparison with the first embodiment, the keyboard device 2C of this embodiment is distinguished by the following aspects. For example, the key 20''' comprises two connecting elements, i.e., a first connecting element 205 and a second connecting element 206. Moreover, the first hook part 2042 and the second hook part 2043 of the stabilizer bar 204 are connected with the first connecting element 205 and a second connecting element 206, respectively.

In this embodiment, the keycap 201C comprises plural third keycap connecting parts 2015 and plural fourth keycap connecting parts 2016. The plural third keycap connecting parts 2015 and plural fourth keycap connecting parts 2016 are formed on the bottom surface of the keycap 201C. In an embodiment, the third keycap connecting parts 2015 are fixed-type hooks, and the fourth keycap connecting parts 2016 are moving-type hooks. Like the connecting element 202A of the first embodiment, the first connecting element 205 is a scissors-type connecting element. The first connecting element 205 comprises a first frame 2021 and a second frame 2022C. The second frame 2022C is pivotally coupled to the first frame 2021. For example, the first frame 2021 is an inner frame, and the second frame 2022C is an outer frame. Similarly, the second connecting element 206 is a scissors-type connecting element. The second connecting element 206 comprises a third frame 2061 and a fourth frame 2062. The fourth frame 2062 is pivotally coupled to the third frame 2061. For example, the third frame 2061 is an inner frame, and the fourth frame 2062 is an outer frame.

In this embodiment, the base coupling structure 213C further comprises a third base connecting part 2133 and a fourth base connecting part 2134. In an embodiment, the third base connecting part 2133 is a third base hook, and the fourth base connecting part 2134 is a fourth base hook.

A first end 20211 of the first frame 2021 is connected with the first keycap connecting part 2011 of the keycap 201C. A second end 20212 of the first frame 2021 is connected with the second base connecting part 2132 of the base plate 21. A first end 20221 of the second frame 2022C is connected with the first base connecting part 2131 of the base plate 21. A second end 20222 of the second frame 2022C is connected with the second keycap connecting parts 2012 of the keycap 201C. A first end 20611 of the third frame 2061 is connected with the third keycap connecting part 2015 of the keycap 201C. A second end 20612 of the third frame 2061 is connected with the fourth base connecting part 2134 of the base plate 21. A first end 20621 of the fourth frame 2062 is connected with the third base connecting part 2133 of the base plate 21. A second end 20622 of the fourth frame 2062 is connected with the fourth keycap connecting parts 2016 of the keycap 201C. Due to above design, the first frame 2021 and the second frame 2022C can be swung relative to each other. That is, the first frame 2021 and the second frame 2022C are switched from an open-scissors state to a stacked state or switched from the stacked state to the open-scissors state. Similarly, due to the above design, the third frame 2061 and the fourth frame 2062 can be swung relative to each other. That is, the third frame 2061 and the fourth frame 2062 are switched from the open-scissors state to the stacked state or switched from the stacked state to the open-scissors state. The connecting relationships between the first connecting element 205, the second connecting element 206 and the keycap 201C are presented herein for purpose of illustration and description only.

While the keycap 201C of any key 20''' is depressed and moved downwardly relative to the base plate 21, the first frame 2021 and the second frame 2022C of the first connecting element 205 are switched from the open-scissors state to the stacked state and the third frame 2061 and a fourth frame 2062 of the second connecting element 206 are switched from the open-scissors state to the stacked state. Moreover, as the keycap 201C is moved downwardly to compress the elastic element 203, the corresponding membrane switch 221 is pushed and triggered by the contacting part 2031 of the elastic element 203. Consequently, the keyboard device 2C generates a corresponding key signal. When the keycap 201C of the key 20''' is no longer depressed, the keycap 201C is moved upwardly relative to the base plate 21 in response to an elastic force of the elastic element 203. Meanwhile, the first frame 2021 and the second frame 2022C are switched from the stacked state to the open-scissors state, and the third frame 2061 and a fourth frame 2062 are switched from the stacked state to the open-scissors state. Consequently, the keycap 201C is returned to its original position.

Moreover, a first frame sliding groove 20223C is formed in a lateral side of the first end 20221 of the second frame 2022C, and a second frame sliding groove 20623 is formed in a lateral side of the first end 20621 of the fourth frame 2062. The transverse bar part 2041 of the stabilizer bar 204 is pivotally coupled to the keycap coupling part 2013 of the keycap 201C. The first hook part 2042 and the second hook part 2043 of the stabilizer bar 204 are inserted into the first frame sliding groove 20223C of the second frame 2022C and the second frame sliding groove 20623 of the fourth frame 2062.

While the keycap 201C of the key 20''' is depressed and moved upwardly or downwardly relative to the base plate 21, the actions of the first connecting element 205 and the second connecting element 206 are similar to those as mentioned above. In addition, the transverse bar part 2041 of the stabilizer bar 204 is pivotally coupled to the keycap coupling part 2013 of the keycap 201C, and the first hook part 2042 and the second hook part 2043 of the stabilizer bar 204 are moved within the first frame sliding groove 20223C of the second frame 2022C and the second frame sliding groove 20623 of the fourth frame 2062, respectively. Consequently, the stabilizer bar 204 is swung. By this design, the key 20''' is kept stable and not inclined while the key 20''' is moved upwardly or downwardly relative to the base plate 21. Moreover, this design is helpful to increase the strength of the keycap 201C.

It is noted that numerous modifications and alterations may be made while retaining the teachings of the invention. For example, two keycap sliding grooves are formed on the bottom surface of the keycap to replace the keycap coupling parts of the third embodiment. The structure of the keycap sliding groove is similar to the structure of the keycap sliding groove, and thus the transverse bar part of the stabilizer bar is movable within the keycap sliding groove. Moreover, a first frame coupling part is located at a lateral side of the first end of the second frame, and a second frame coupling part is located at a lateral side of the first end of the fourth frame. The structure of the first frame coupling part and the structure of the second frame coupling part are similar to the structure of the frame coupling part of the second embodiment. The first hook part and the second hook part of the stabilizer bar are respectively coupled to the first frame coupling part and the second frame coupling part. While the keycap of the key is depressed and moved upwardly or downwardly relative to the base plate, the first hook part and the second hook part of the stabilizer bar are pivotally coupled to the coupled to the first frame coupling part and the second frame coupling part, and the transverse bar part of the stabilizer bar is moved within the keycap sliding groove of the keycap. By this design, the key is kept stable and not inclined while the key is moved upwardly or downwardly relative to the base plate. Moreover, this design is helpful to increase the strength of the keycap.

From the above descriptions, the present invention provides the keyboard device. The transverse bar part of the stabilizer bar of the key is connected between the keycap and the connecting element. Since the stabilizer bar does not readily collide with or knock on a plate body and the base coupling structure of a base plate, the generated noise is reduced during the process of operating the key. Consequently, the operating comfort to the user is enhanced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

a membrane circuit board comprising a membrane switch;

a base plate comprising a plate body and a base coupling structure, wherein the plate body is located under the membrane circuit board, and the base coupling structure is protruded upwardly and penetrated through the membrane circuit board; and a key comprising:

a keycap located over the membrane circuit board, wherein when the keycap is moved downwardly relative to the membrane circuit board, the membrane switch is triggered;

a first connecting element connected between the keycap and the base plate, wherein the first connecting element comprises a first frame and a second frame, and the second connecting element comprises a third frame and a fourth frame, wherein while the keycap is moved upwardly or downwardly relative to the membrane circuit board, the first frame and the second frame are swung relative to each other and the third frame and the fourth frame are swung relative to each other;

a second connecting element connected between the keycap and the base plate; and a stabilizer bar comprising a transverse bar part, a first hook part and a second hook part, wherein the first hook part and the second hook part are respectively located at two ends of the transverse bar part, the transverse bar part is connected with the keycap, the first hook part is connected with the first connecting element, and the second hook part is connected with the second connecting element, wherein while the keycap is moved upwardly or downwardly relative to the base plate, the stabilizer bar is swung to stabilize the key, wherein the first hook part of the stabilizer bar is connected with the second frame, and the second hook part of the stabilizer bar is connected with the fourth frame, wherein a first end of the second frame further comprises a first frame sliding groove, and the first hook part of the stabilizer bar is movable within the first frame sliding groove, wherein a first end of the fourth frame further comprises a second frame sliding groove, and the second hook part of the stabilizer bar is movable within the second frame sliding groove, wherein the keycap further comprises a keycap coupling part, and the transverse bar part of the stabilizer bar is pivotally coupled to the keycap coupling part.

2. The keyboard device according to claim 1, wherein the first frame sliding groove is located at a lateral side of the first end of the second frame, and the second frame sliding groove is located at a lateral side of the first end of the fourth frame.

3. The keyboard device according to claim 1, wherein the keycap further comprises a first keycap connecting part, a second keycap connecting part, a third keycap connecting part and a fourth keycap connecting part, wherein the first keycap connecting part is connected with a first end of the first frame, the second keycap connecting part is connected with a second end of the second frame, the third keycap connecting part is connected with a first end of the third frame, and the fourth keycap connecting part is connected with a second end of the fourth frame.

4. The keyboard device according to claim 1, wherein the base coupling structure comprises a first base connecting part, a second base connecting part, a third base connecting part and a fourth base connecting part, wherein the second base connecting part is connected with a second end of the first frame, the first base connecting part is connected with a first end of the second frame, the fourth base connecting part is connected with a second end of the third frame, and the third base connecting part is connected with a first end of the fourth frame.

5. The keyboard device according to claim 1, wherein the key further comprises an elastic element, and the elastic element is connected between the keycap and the membrane circuit board and comprises a contacting part, wherein while the keycap is depressed, the elastic element is compressed and the membrane switch is pushed by the contacting part, wherein when the keycap is not depressed, the keycap is returned to an original position in response to an elastic force provided by the elastic element.

* * * * *